US008820425B2

(12) United States Patent
Gatling et al.

(10) Patent No.: US 8,820,425 B2
(45) Date of Patent: Sep. 2, 2014

(54) FILTERED CAKE CANDLE EXTINGUISHER

(76) Inventors: Jacqueline A. Gatling, Marlton, NJ (US); Vonna Meier, Pittsburgh, PA (US)

( * ) Notice: Subject to any disclaimer, the term of this patent is extended or adjusted under 35 U.S.C. 154(b) by 715 days.

(21) Appl. No.: 12/844,690

(22) Filed: Jul. 27, 2010

(65) Prior Publication Data

US 2011/0048748 A1 Mar. 3, 2011

Related U.S. Application Data

(63) Continuation-in-part of application No. 12/238,971, filed on Sep. 26, 2008, now abandoned.

(60) Provisional application No. 61/230,233, filed on Jul. 31, 2009, provisional application No. 60/976,443, filed on Sep. 30, 2007.

(51) Int. Cl.

| | |
|---|---|
| ***A62C 39/00*** | (2006.01) |
| ***F23Q 25/00*** | (2006.01) |
| *A62C 3/00* | (2006.01) |
| *A62C 3/02* | (2006.01) |

(52) U.S. Cl.

CPC ..... *F23Q 25/00* (2013.01); *A62C 3/008* (2013.01); *A62C 3/0207* (2013.01)

USPC ..... 169/91; 169/54; 431/145; 431/144; 446/209

(58) Field of Classification Search

CPC ..... A62C 3/0207; A62C 3/008; A63H 5/00; F23Q 25/00

USPC ..... 169/46, 54, 91; 446/209; 239/211; 431/144, 145

See application file for complete search history.

(56) References Cited

U.S. PATENT DOCUMENTS

| | | | | |
|---|---|---|---|---|
| 330,972 | A | 11/1885 | Ellis | |
| 357,802 | A * | 2/1887 | White | 446/209 |
| 580,527 | A | 4/1897 | Martin | |
| 986,139 | A | 3/1911 | Cather | |
| 1,001,218 | A | 5/1911 | Parenteau | |
| 1,061,302 | A * | 5/1913 | Lohr | 446/209 |
| 1,333,011 | A | 3/1920 | Crady | |
| 1,763,336 | A * | 6/1930 | Wilder | 84/387 R |
| 3,715,448 | A | 2/1973 | Itoh | |
| 4,298,475 | A | 11/1981 | Gartner | |
| 4,642,065 | A | 2/1987 | Whedon et al. | |
| 4,769,144 | A | 9/1988 | Nohren, Jr. | |
| 4,798,671 | A | 1/1989 | Mijers et al. | |

(Continued)

FOREIGN PATENT DOCUMENTS

| | | |
|---|---|---|
| JP | 2006131253 | 5/2006 |
| JP | 2006195393 | 7/2006 |

OTHER PUBLICATIONS

International Search Report for related International Application No. PCT/US2008/077815, which was issued by the Korean Intellectual Property Office on Apr. 20, 2009.

*Primary Examiner* — Dinh Q Nguyen

(74) *Attorney, Agent, or Firm* — Myers Wolin, LLC

(57) ABSTRACT

A filtered cake candle extinguisher device comprises a filter, a mouthpiece connected to the filter and a decorative cover for covering filter. A sound generator may be provided to enhance the user's enjoyment while using the extinguisher device to blow out a candle or candles.

11 Claims, 10 Drawing Sheets

(56) References Cited

U.S. PATENT DOCUMENTS

| | | | | |
|---|---|---|---|---|
| 4,995,976 | A | 2/1991 | Vermes et al. | |
| 5,156,335 | A | 10/1992 | Smith et al. | |
| 5,234,368 | A * | 8/1993 | Carraway | 446/202 |
| 6,010,458 | A | 1/2000 | Roberts | |
| 6,811,036 | B1 | 11/2004 | Vaiano et al. | |
| 2006/0093976 | A1 | 5/2006 | Roccograndi | |
| 2009/0060705 | A1 | 3/2009 | Wyatt | |

* cited by examiner

FILTERED CAKE CANDLE EXTINGUISHER

CROSS-REFERENCE TO RELATED APPLICATIONS

This application is a continuation-in-part of U.S. application Ser. No. 12/238,971 filed on Sep. 26, 2008, which claims the benefit of U.S. Provisional Application No. 60/976,443 filed on Sep. 30, 2007, the contents of each of which are herein incorporated by reference. This application also claims the benefit of 61/230,233 filed on Jul. 31, 2009, the contents of which are herein incorporated by reference.

FIELD OF THE INVENTION

The present invention relates to a device for blowing out candles on a birthday cake generally, and more particularly to an economical, effective, easy to use new filtering device for blowing out candles on a birthday cake while minimizing the spread of germs.

BACKGROUND

Birthday, holiday and occasion cakes are often decorated with designs with a particular motif or theme to commemorate a particular event. The cakes are meant to be visually pleasing and protected until the cake is sliced for serving. Candles are frequently placed on cakes to help commemorate the event being celebrated. After the candles are lit, by a match or other means, the person or persons who are involved in the commemoration are then asked to blow the candle or candles out to extinguish the same.

To some, the act of blowing out the candles raises concerns about the transmission of germs, particularly if the birthday boy or girl is sick. With one forceful blow, a sick individual can contaminate an entire cake. If it weren't for the sentimental attachment that the public has with this tradition, and the focus and emphasis placed on the birthday girl or boy (or man or woman for that matter) to blow out the candles, people would realize that the act of blowing out the candles on a cake is about as appealing as having someone blow all over one's plate of food. There is a need, therefore, for a device or the like for blowing out candles on a cake without jeopardizing the health of the participants and future consumers of the cake.

SUMMARY

One embodiment of a filtered cake candle extinguisher device comprises a filter, a mouthpiece connected to the filter and a decorative cover for covering filter. A user blows into the mouthpiece and through the filter so that the air that contacts the cake and the candles is filtered to prevent the spread of the user's germs and the ultimate contamination of the cake. In one embodiment, a sound generator may be provided in conjunction with the filter to enhance the user's enjoyment while using the extinguisher device to blow out the candles.

DETAILED DESCRIPTION OF THE PREFERRED EMBODIMENTS

Figure 1:
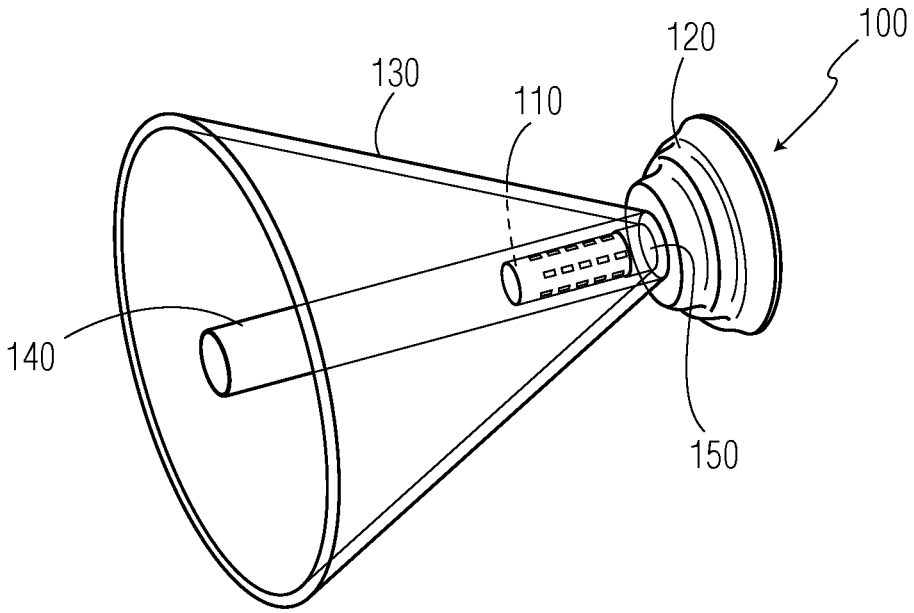
FIG. 1 is one embodiment of a filtered cake candle extinguisher device of the present invention.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
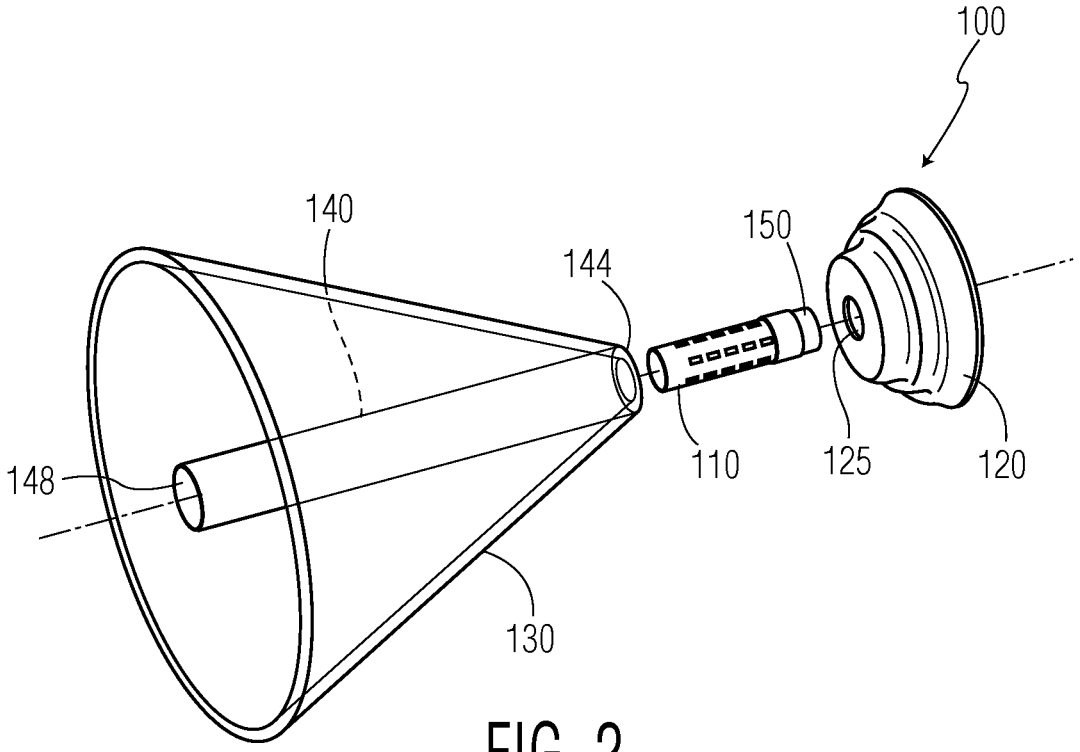
FIG. 2 is an exploded view of the device of FIG. 1.
Figure 4:
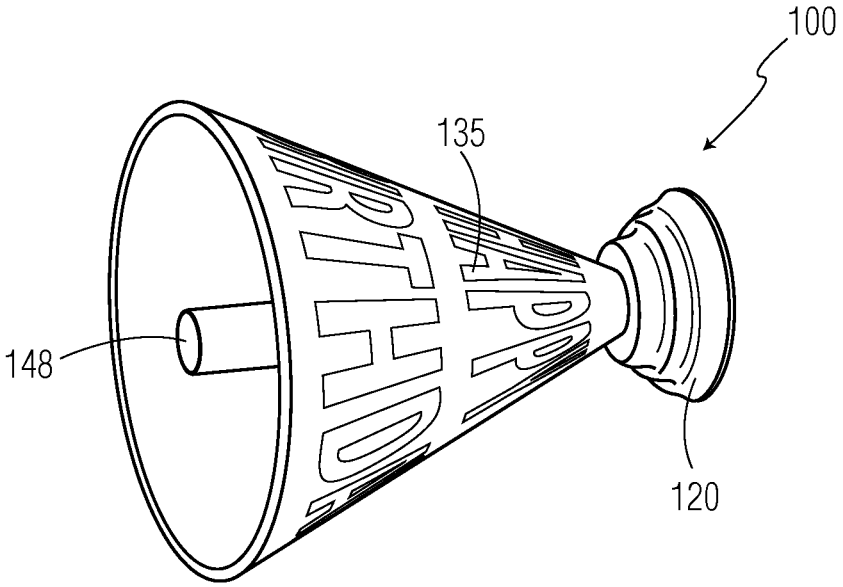
FIGS. 4-9 are alternative embodiments of the device of FIG. 1.
Figure 5:
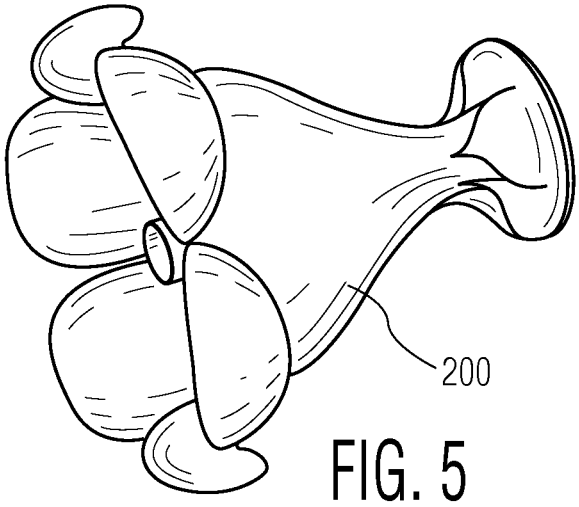
Figure 6:
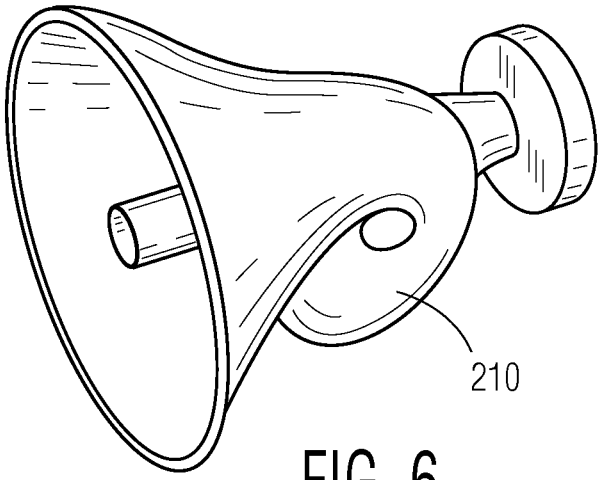
Figure 7:
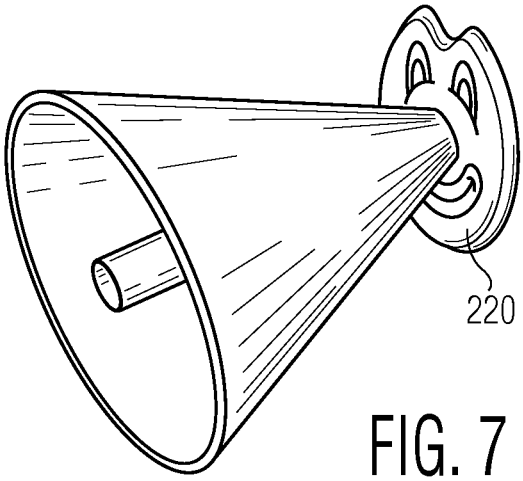
Figure 8:
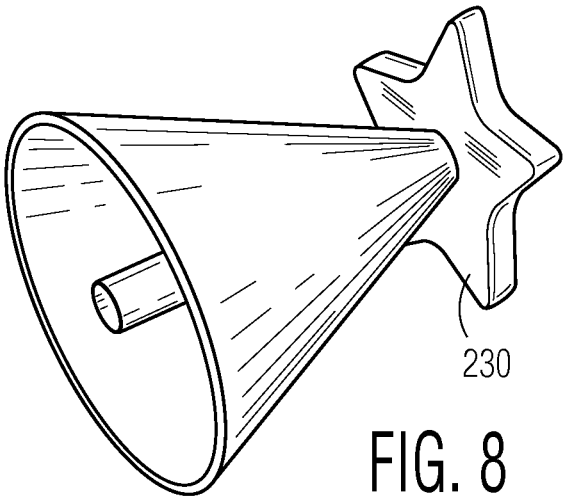
Figure 9:
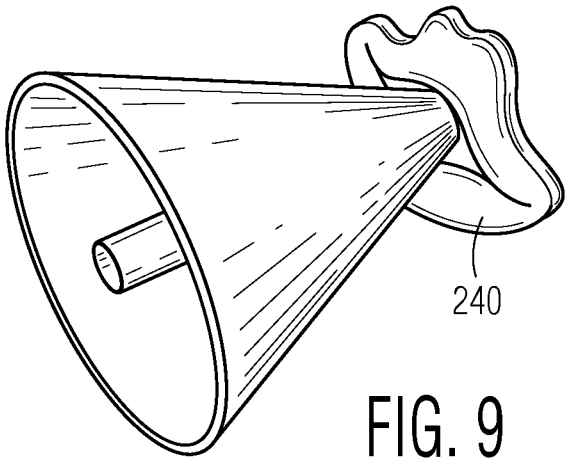

FIGS. 1 and 2 illustrate one embodiment of a filtered cake candle extinguisher device 100 of the present invention, hereafter referred to as extinguisher 100. Extinguisher 100 further preferably comprises a filter 110, a mouthpiece 120 with an opening 125 that is connected to the filter 110, and a decorative cover 130 for covering at least a portion of the filter 110. The decorative cover 130 is preferably formed in the shape of a cone, although other shapes are contemplated such as, but not limited to a flower 200 (FIG. 5) or a musical instrument 210 (FIG. 6). The decorative cover 130 is preferably further adorned with a message 135 (FIG. 4) that is indicative of a particular theme or occasion, such as a birthday, wedding, graduation, etc. Similarly, the mouthpiece 120 can have a variety of designs such as, but not limited to, a face 220 (FIG. 7), a star 230 (FIG. 8), or lips 240 (FIG. 9). Other designs, shapes and themes are contemplated to accommodate a variety of potential uses.

Figure 3:
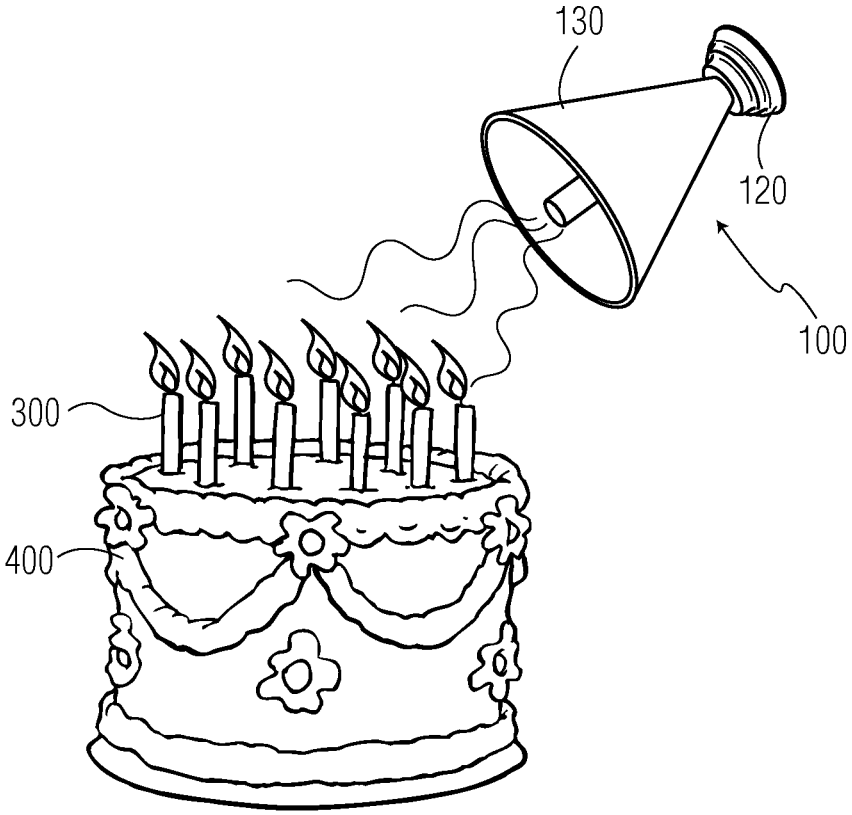
FIG. 3 illustrates use of the device of FIG. 1.

In the embodiment of FIGS. 1 and 2, the filter 110 is preferably disposed within a straw section 140 that has an inlet 144 and an outlet 148, the inlet 144 receiving the filter 110 and the outlet 148 being positioned in the direction of the candle or candles to be extinguished (see FIG. 3). The outlet 148 is preferably hidden by the decorative cover 130, although it could preferably be flush with or extend slightly beyond the end of the decorative cover 130. A variety of filter constructions are contemplated, including a chemical cartridge filter or filters comprising charcoal, activated charcoal, wool, paper, plastic, glass, cellulose, or combinations thereof. The main function of the filter 110 is to remove or neutralize contaminants, particles, germs, bacteria, etc., from the air stream and the user so that a person using the extinguisher 100 to blow out the candles 300 on a birthday cake 400, for example, will not contaminate the cake 400 and perpetuate the spread of germs, disease, sickness, etc. The filter 110 is preferably designed to function in a single direction from the mouthpiece 120 to the outlet 148 of the straw section 140, although the filter medium should preferably not impede the air flow too much so that the user has to exert considerable force while blowing. In this regard, the straw section 140 is preferably between six and eighteen inches long to prevent a considerable reduction in blowing force at the outlet 148.

A sound generator or resonator 150 is preferably positioned in front of the filter 110 so that a user can make a pleasing sound or musical tune while using the extinguisher device 100. Of course, placement of the sound generator 150 would be acceptable anywhere along the user's blow path, i.e., from the mouthpiece 120 to the outlet 148 of the straw section 140. The sound generator 150 could be a separate element and attached to the filter 110 at the point of manufacture, or the sound generator 150 and filter 110 could be manufactured as a single, integrated component. The sound generator 150 is preferably inexpensive in the nature of a reed or whistle device, although more expensive options that require electronics or circuitry are certainly contemplated.

FIG. 2 illustrates one embodiment of an assembly of the extinguisher 100 of FIG. 1, with the straw section 140 attached to the decorative cover 130 and the filter section 110 attached between the decorative cover 130 and the mouthpiece 120. For example, the filter section 110 could be threaded to cooperatively mate with a threaded section on the straw inlet 144, while the sound generator 150 could have a similar mating relationship with the mouthpiece 120. Alternatively, all pieces of the extinguisher 100 could be attached by a force fit, or alternatively, by a more permanent fit created at the point of manufacture. The entire extinguisher 100 is preferably disposable and designed for a single use, and therefore the materials used to form the mouthpiece 120, decorative cover 130 and straw section 140 should be relatively inexpensive. For example, the straw section 140 could be formed from plastic, while the decorative cover 130 and mouthpiece 120 could be formed from plastic, paper, cardboard or combinations of the same. Other materials and constructions are contemplated.

One function of the decorative cover 130 is to provide a handgrip for the user during operation of the extinguisher device 100. The cover 130 could additionally be provided with a textured outer surface and/or molded finger portions (not shown), for example, to facilitate gripping. Furthermore, the cover 130 could be formed in a variety of shapes, sizes, colors, textures, materials, etc., to commemorate any occasion.

Operation of the extinguisher 100 is relatively straightforward and illustrated in FIG. 3. A user first places the extinguisher 100 in proximity to the candles 300 to be extinguished. Then the user places his/her mouth on the mouthpiece 120 and blows air through the opening 125 and through the filter 110 with the filtered air escaping through the outlet 148 until the candle or candles 300 is/are extinguished. During such time, the sound generator 150 generates a pleasing sound or musical tune such as, for example, the first couple of notes of "Happy Birthday" or the entire song for that matter. As the straw outlet 148 is relatively focused, the user may employ a sweeping motion while blowing as is traditional when trying to extinguish more than one candle. After all of the candles are extinguished, the extinguisher device 100 is discarded.

While the entire extinguisher device 100 is preferably discarded after a single use, a multi-use embodiment may be commercialized where only certain elements are disposable. For example, if the filter 110 is effective for up to ten uses, then it might be desirable to have only a disposable mouthpiece 120. Alternatively, both the mouthpiece 120 and the decorative cover 130 might be disposable if the type of filter used is comparatively expensive. A variety of disposable and non-disposable options are contemplated to address a particular environment, user, event or marketing price point.

Figure 10:
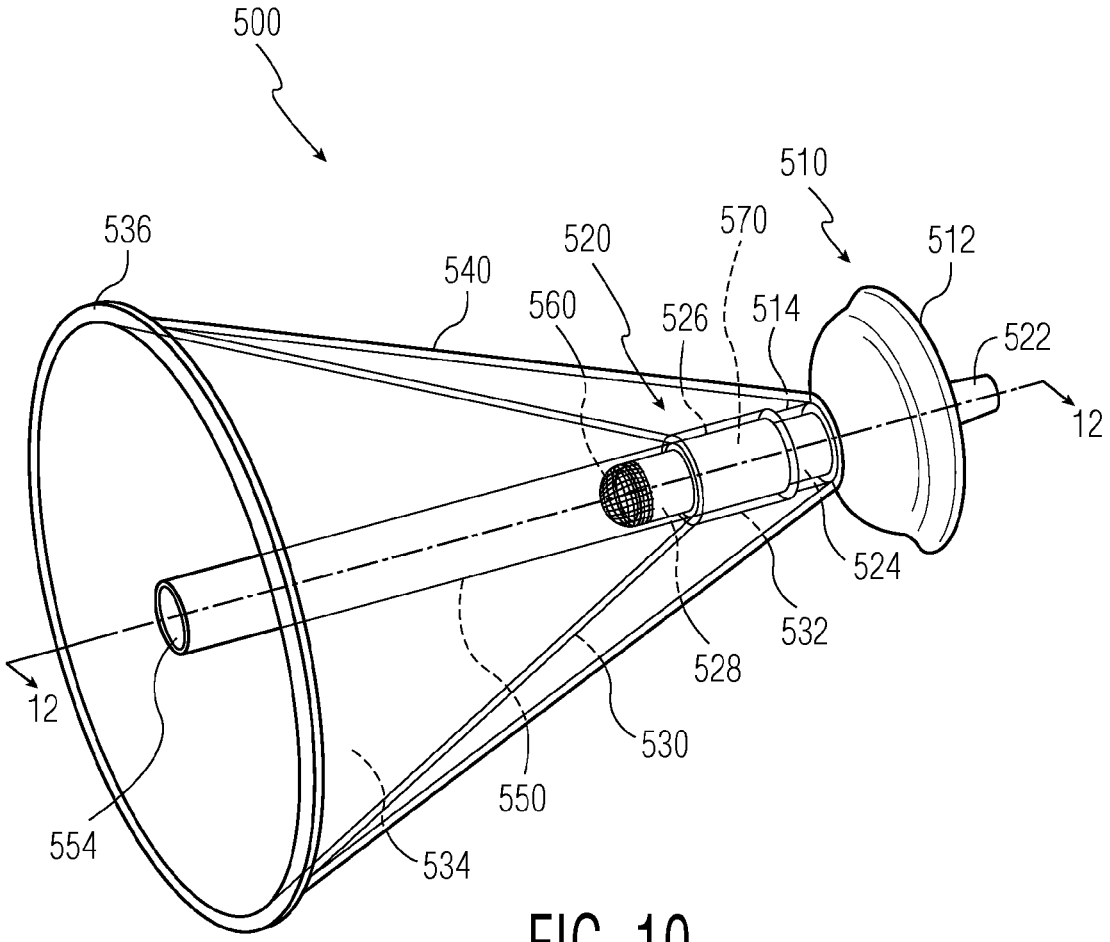
FIG. 10 is one embodiment of a filtered cake candle extinguisher device of the present invention.
Figure 11:
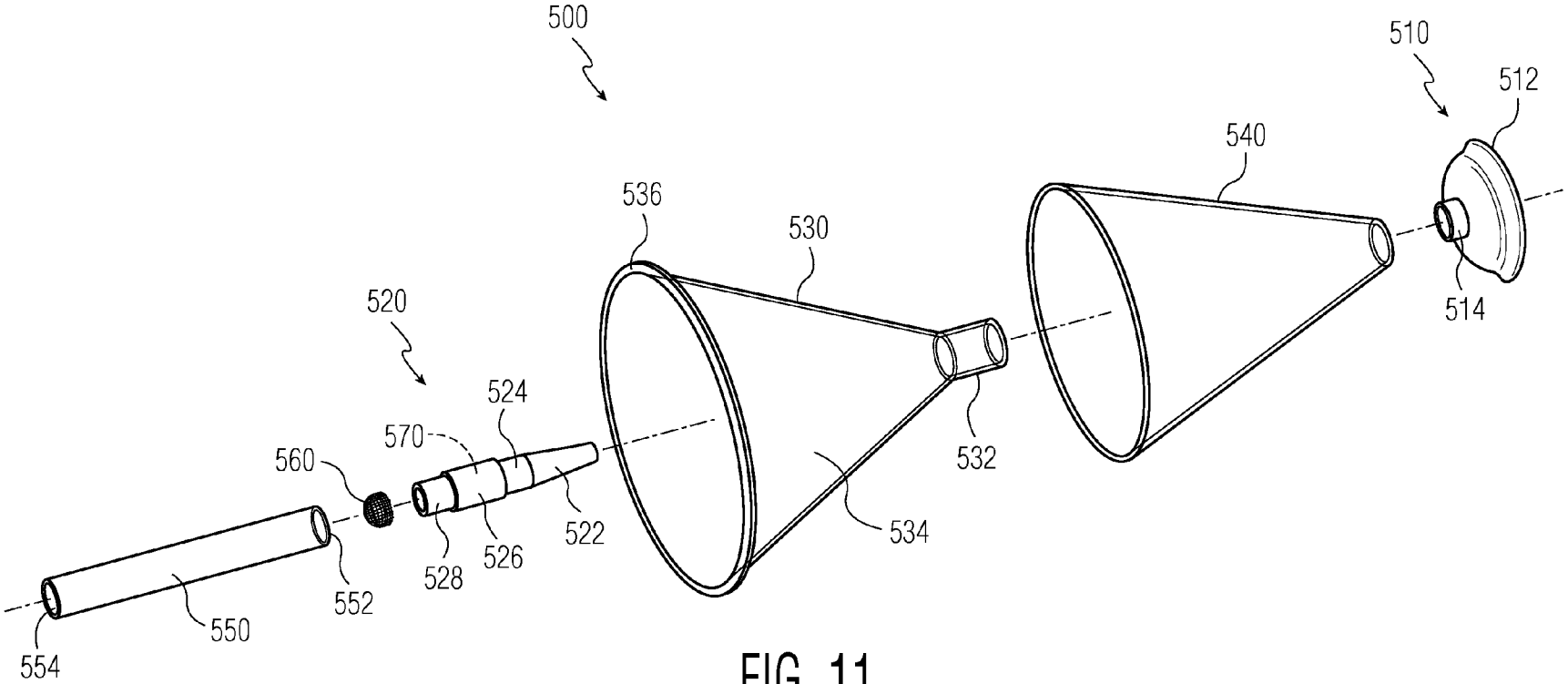
FIG. 11 is an exploded view of the device of FIG. 10.
Figure 12:
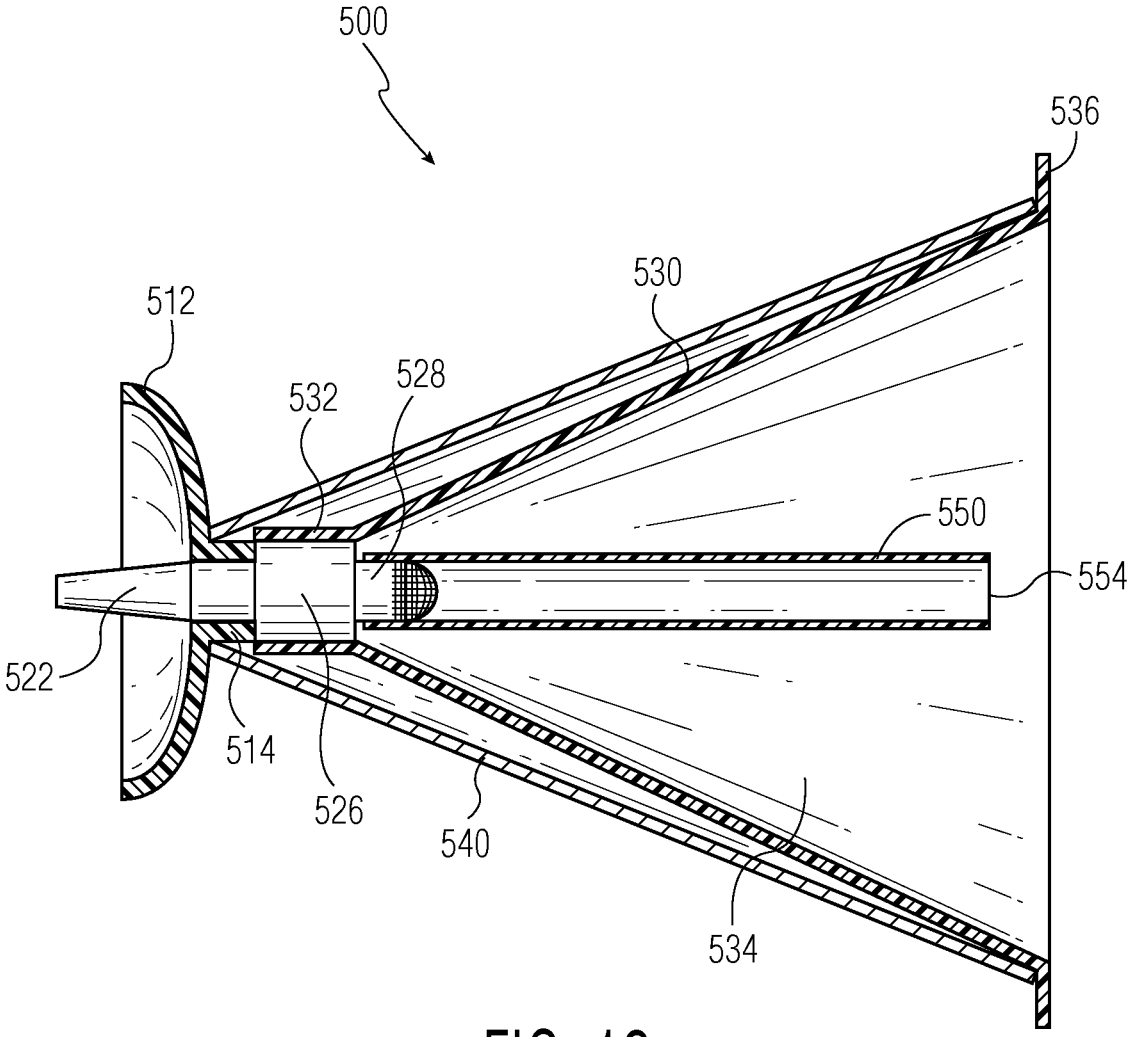
FIG. 12 is a sectional view taken along line 12-12 of FIG. 10.

FIGS. 10 through 12 illustrate an alternate embodiment of a filtered cake candle extinguisher device 500 of the present invention, hereafter referred to as extinguisher 500. Extinguisher 500 further preferably comprises a mouth guard 510 having a shield 512 and a collar 514, a mouthpiece 520 preferably attached to the mouth guard 510, a housing 530 preferably attached to the mouthpiece 520 for supporting a preferably removable decorative cover 540, an air transport or straw section 550 and a filter 560 disposed between the straw section 550 and the mouthpiece 520. The mouthpiece 520 further comprises a mouth-engaging portion 522 for engagement by a user, a collar-engaging portion 524 for engagement with the collar 514 of the mouth guard 510, a housing support 526 for engagement with a collar 532 on the housing 530, and a straw support 528 for engagement with an inlet 552 of the straw section 550. The filter 560 is preferably sandwiched between the straw support 528 and the inlet 552 of the straw section 550 as will be described below in more detail. In a preferred embodiment, the mouthpiece 520 is press fit into the mouth guard 510, the decorative cover 540 is placed onto the housing 530, the housing 530 is press fit onto the mouthpiece 520, the filter 560 is positioned over the straw support 528 and the straw section 550 is press fit onto the mouthpiece 520 over the filter 560 and straw support 528. While the embodiment of FIGS. 10 through 12 illustrates a certain relative arrangement of the elements of the extinguisher 500, it will be appreciated that various arrangements of elements are contemplated.

In the embodiment of FIGS. 10 through 12, various materials are contemplated for the manufacture of the various elements. In a preferred embodiment, the mouth guard 510, mouthpiece 520 and housing 530 are preferably manufactured from, in one example, an injection molded polyethylene plastic. Other materials are contemplated. An injection molded polyethylene plastic is generally rigid enough to firmly support a press fit interconnection between the mouth guard 510 and mouthpiece 520, and between the mouthpiece 520 and housing 530. Of course, other plastics, papers, and like are contemplated and may be useful depending on the environment. For example, a lower cost and/or completely disposable option may only utilize paper-based materials and/or less rigid plastic materials. In general, plastic parts that are designed to be press-fit together are easy to manufacture, which translates into lower production costs. In addition, by avoiding molding undercuts, the production mold cost and cycle time of each part being molded will be reduced.

The housing 530 includes a collar 532 on one end, a rim 536 on the opposite end, and a conical sidewall 534 located therebetween, with the rim 536 having a larger diameter than the collar 532. While the housing 530 is illustrated as being funnel-shaped, it will be appreciated that other structural configurations are contemplated without departing from the scope of the invention. The decorative cover 540 is aligned and retained between the mouth guard 510 and the rim 536 of the housing 530 and is slid over the housing 530 prior to the engagement of the mouth guard 510 with the housing 530 via the mouthpiece 520. Specifically, in one embodiment of assembly, the housing support 526 of the mouthpiece 520 is press fit into the collar 532 of the housing 530, then the decorative cover 540 is slid over the housing 530, and then the mouth guard 510 is press fit onto the collar-engaging portion 524 of the mouthpiece 520 such that the decorative cover 540 is constrained between the shield 512 of the mouth guard 510 and the rim 536. While the rim 536 is provided to keep the decorative cover 540 in place during use, it also serves as a shield to protect the decorative cover 540 from exposure to heat from a candle (for example, candle 300 of FIG. 3) or the like.

Figure 13:
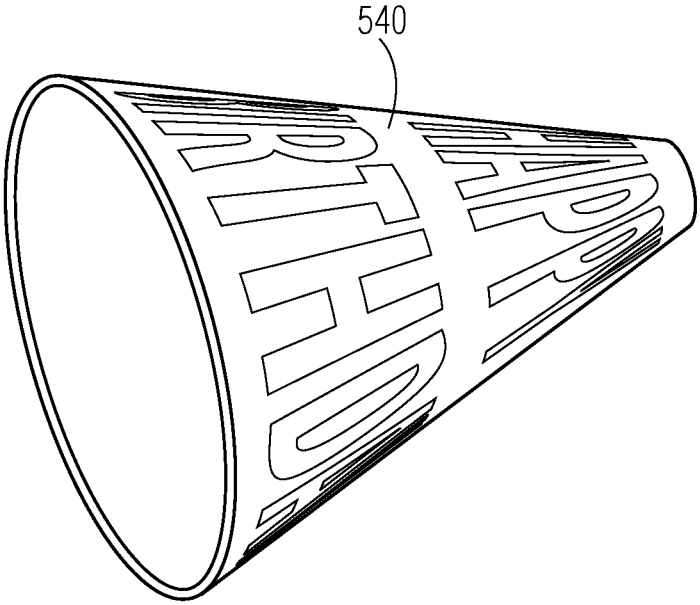
FIGS. 13-17 are alternative embodiments of a decorative cover used with the device of FIG. 10.
Figure 14:
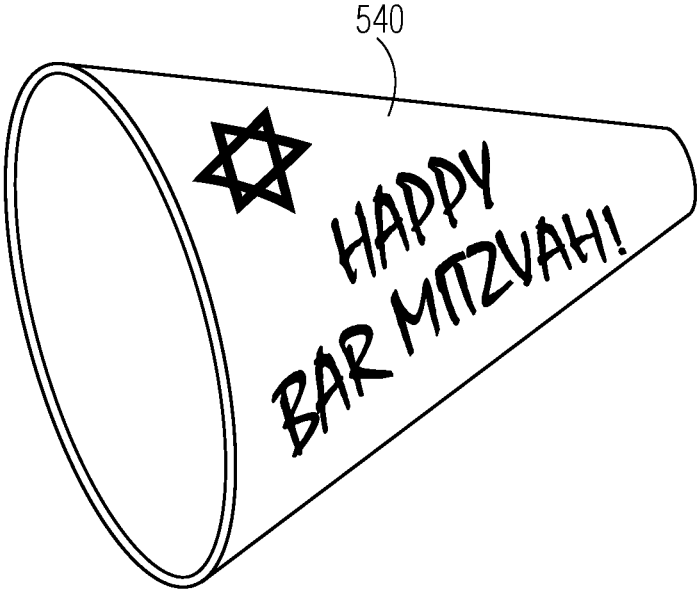
Figure 15:
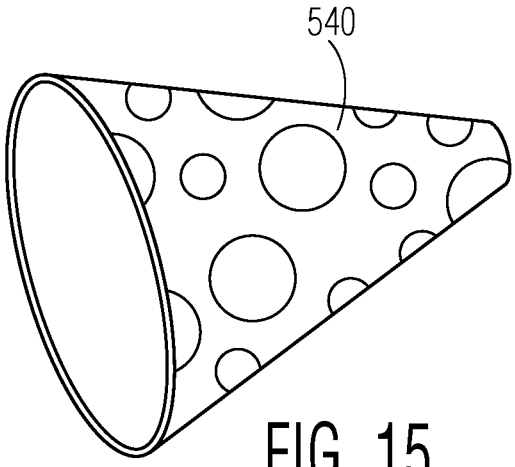
Figure 16:
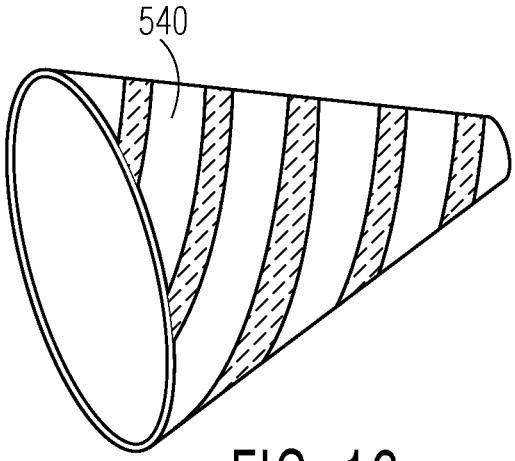
Figure 17:
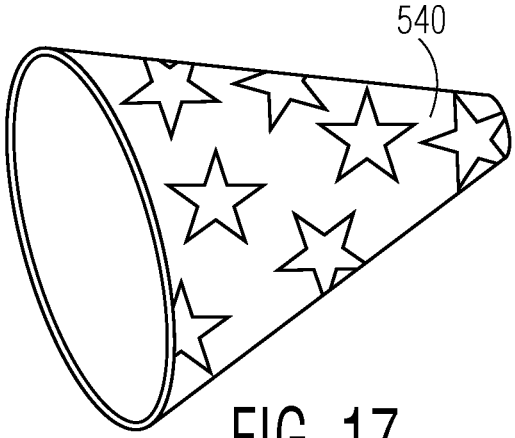

In the embodiments of FIGS. 10 through 12, the decorative cover 540 is preferably formed in the shape of a cone so as to be aligned with and follow the conical shape of the housing sidewall 534, although other shapes are contemplated. Such other shapes may include, but are not limited to, the shapes illustrated in FIGS. 5 and 6 described above. While it is preferred, it is not necessary that the decorative cover 540 and the housing 530 have the same general shape. In one embodiment, the decorative cover 540 is a lightweight cardboard or chipboard wrapper that functions as a printable surface for various themes and occasions (including, but not limited to, Birthdays (FIG. 13), Bar Mitzvahs (FIG. 14), graduations, generic designs (FIGS. 15 through 17), etc.), generic and licensed characters, and the like. In other embodiments, the cover 540 could be a lightweight plastic sleeve, a cling wrap label, a sticker made of various materials such as paper, plastic, foil and the like. Printing many different themes on removable covers, wrappers and the like can be more cost effective than printing many different themes directly onto the housing 530, for example. This method of decorating the cover 540 also results in increased print quality and flexibility with respect to designs, design changes, personalization, etc. The themes do not only have to concern specific occasions, but can also reflect certain color schemes and logos from schools and universities, professional teams, businesses and corporate logos, national flags, movie logos and licensed characters, and the like. This feature allows for extreme diversity in a product line, particularly with respect to the party industry where licensed characters and themes are so prevalent. In one embodiment, the decorative cover 540 is preferably further adorned with a message (FIGS. 13 and 14 for example) that is indicative of a particular theme or occasion, such as a birthday, wedding, graduation, etc. Similarly, the mouth guard 510 and shield 512 can have a variety of designs such as, but not limited to, a face (FIG. 7 for example), a star (FIG. 8 for example), or lips (FIG. 9 for example). Other designs, shapes and themes are contemplated to accommodate a variety of potential uses.

One function of the decorative cover 540 is to provide a handgrip for the user during operation of the extinguisher device 500. The cover 540 could additionally be provided with a textured outer surface and/or molded finger portions (not shown), for example, to facilitate gripping. Furthermore, the cover 540 could be formed in a variety of shapes, sizes, colors, textures, materials, etc., to commemorate any occasion.

In the embodiment of FIGS. 10 through 12, a sound generator or resonator 570 is preferably incorporated into the mouthpiece 520 so that a user can make a pleasing sound or musical tune while using the extinguisher device 500. Alternatively, the sound generator 570 could make a noisemaker sound that it typically heard at children's birthday parties. Of course, placement of the sound generator 570 would be acceptable anywhere along the user's blow path, i.e., from the mouthpiece 520 to the outlet 554 of the straw section 550. The sound generator 570 could be a separate element that is attached to the mouthpiece 520 at the point of manufacture, or it can be manufactured as a single, integrated component. The sound generator 570 is preferably inexpensive in the nature of a reed or whistle device, although more expensive options that require electronics or circuitry are certainly contemplated.

In the embodiment of FIGS. 10 through 12, the filter 560 is preferably a thin piece or disc of flexible material or fabric that is sandwiched between the straw support 528 and the inlet 552 of the straw section 550 and functions to remove germs and the like without impeding airflow and without detrimentally affecting the acoustics of the sound generator 570. Specifically, the filter 560 partially wraps around the straw support 528 when the inlet 552 of the straw section 550 is attached onto the straw support 528. In one embodiment, a material formed from a nylon and spandex blend is used due to its breathability and other desirable properties as noted above. While a nylon and spandex blend is disclosed, other materials are contemplated, as long as such materials do not restrict the airflow too much to extinguish a candle and do not negatively affect the sound resonator acoustics. In addition to a thin material filter 560 as described herein, a variety of filter constructions are contemplated for inclusion somewhere between the mouth-engaging portion 522 of the mouthpiece 520 and the outlet 554 of the straw section 550, including a chemical cartridge filter or filters comprising charcoal, activated charcoal, wool, paper, plastic, glass, cellulose, or combinations thereof. The main function of the filter 560 is to remove or neutralize contaminants, particles, germs, bacteria, etc., from the air stream and the user so that a person using the extinguisher 500 to blow out the candles 300 (FIG. 3) on a birthday cake 400 (FIG. 3), for example, will not contaminate the cake 400 and perpetuate the spread of germs, disease, sickness, etc.

The straw section 550 is preferably constructed of a thinly extruded polyethylene, although other materials are contemplated. Straw sections with heavier wall thicknesses were experimented with, but thin walled straw sections are preferred because such material tends to not dampen the sound vibrations generated by the sound generator 570. As noted previously, the straw section 550 is preferably cylindrical and between six and eighteen inches long to prevent a considerable reduction in blowing force at the outlet 554 of the straw section 550. Other shapes and dimensions are contemplated.

FIGS. 10 and 12 illustrates one embodiment of an assembly of the extinguisher 500, with the straw section 550 attached over the filter 560 to the mouthpiece 520, the mouthpiece 520 attached to the housing 530, the decorative cover 540 attached to the housing 530, and the mouth guard 510 attached to the mouthpiece 520. The engagement of the mouthpiece 520 to the mouth guard 510, the housing 530 and the straw section 550 is preferably accomplished with a press fit, by a force fit, or alternatively, by a more permanent fit created at the point of manufacture. In one embodiment, the entire extinguisher 500 is preferably disposable and designed for a single use, and therefore the materials used to form all of the components should be relatively inexpensive. In another embodiment, all of the components with the exception of the decorative cover 540 may be washable including the filter 560. Alternatively, the filter 560 may be a single-use, disposable filter.

Operation of the extinguisher 500, which, in one embodiment, looks like a party horn and sounds like a noisemaker, is relatively straightforward. A user first places the extinguisher 500 in proximity to the candles 300 (FIG. 3) to be extinguished. Then the user places his/her mouth on the mouthpiece 520 and blows air through the filter 560 with the filtered air escaping through the outlet 554 of the straw section until the candle or candles 300 is/are extinguished. The filter 560 effectively blocks germs and spittle from being able to pass from the user's mouth onto the cake. During such time, the sound generator 570 generates a pleasing sound or musical tune such as, for example, the first couple of notes of "Happy Birthday" or the entire song for that matter. As the straw outlet 554 is relatively focused, the user may employ a sweeping motion while blowing as is traditional when trying to extinguish more than one candle. After all of the candles are extinguished, the extinguisher 500 is either reused as discussed above or discarded or recycled.

Figure 18:
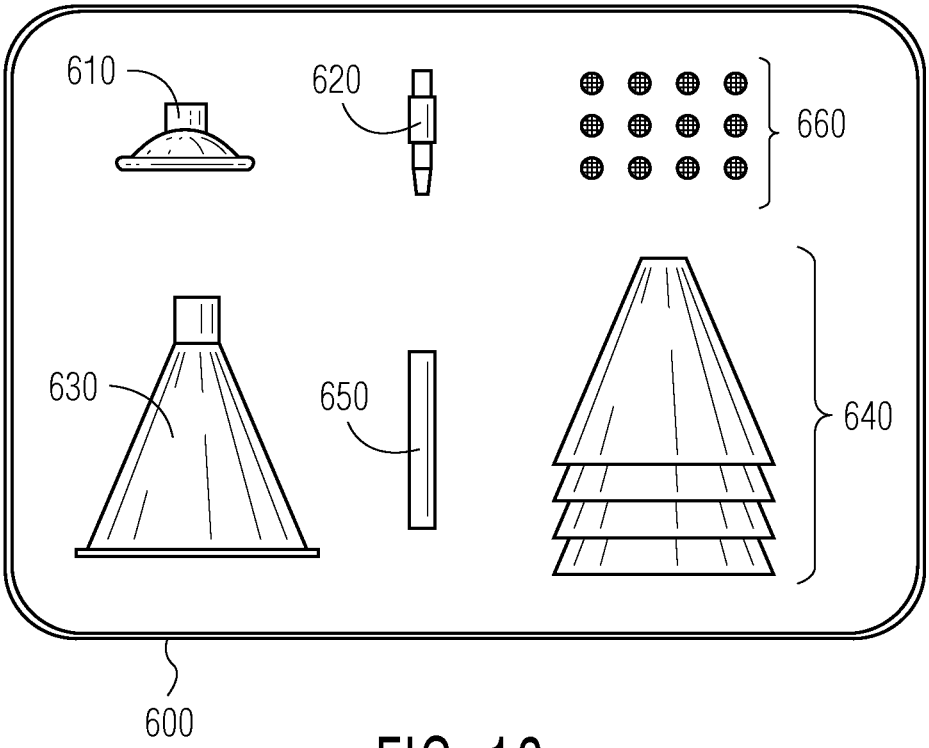
FIG. 18 illustrates a kit incorporating one embodiment of a filtered cake candle extinguisher of the present invention.

FIG. 18 illustrates one embodiment of an all-occasion kit 600 including at least one mouth guard 610, at least one mouthpiece 620, at least one housing 630, a plurality of decorative covers 640 for a plurality of occasions, at least one straw section 650, and a plurality of filters 660. While at least one of several items is disclosed and shown, it will be appreciated that a plurality of each of the kit components can be included in the kit. In this embodiment, it is contemplated that only the filter 660 is a single-use item, with all other items being easily washable and/or reusable. Of course, a fully disposable kit is also contemplated that includes multiples of each of the above-referenced extinguisher components. Each of the components could be formed from plastic, paper, cardboard or combinations of the same. Other materials and constructions are contemplated. Additional kits of separate or bundled components are also contemplated in the event it is desired to only purchase replacement covers 640, replacement filters 660, a replacement mouthpiece or the like.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A filtered cake candle extinguisher comprising:

a) a mouth-engaging portion;

b) an air transport portion;

c) a filter disposed between the mouth-engaging portion and the air transport portion;

d) a housing for covering at least a portion of the mouth-engaging portion, air transport portion or filter; and e) a decorative cover for covering at least the housing extending for a length from the housing along an axis;

f) wherein the housing includes a rim for retaining the decorative cover on the housing during use, and g) wherein the air transport portion extends coaxially with the decorative cover for at least a majority of the length of the decorative cover.

2. The filtered cake candle extinguisher of claim 1, further comprising a sound device that generates a sound when air passes therethrough.

3. The filtered cake candle extinguisher of claim 2, wherein the sound device is incorporated into the mouth-engaging portion.

4. The filtered cake candle extinguisher of claim 1, wherein the filter is a fabric disc.

5. The filtered cake candle extinguisher of claim 1, wherein the filter is partially wrapped around the mouth-engaging portion.

6. The filtered cake candle extinguisher of claim 1, wherein the filter further comprises a nylon and spandex blend.

7. The filtered cake candle extinguisher of claim 1, wherein the filter further comprises one of charcoal, activated charcoal, wool, plastic, glass, cellulose, or combinations thereof.

8. The filtered cake candle extinguisher of claim 1, further comprising a removable decorative cover.

9. A filtered cake candle extinguisher kit comprising:

a) at least one mouth-engaging portion;

b) at least one air transport portion;

c) at least one filter for positioning between the mouth-engaging portion and the air transport portion;

d) at least one housing for covering at least a portion of the at least one mouth-engaging portion, the at least one air transport portion or the at least one filter; and e) at least one decorative cover for covering at least the at least one housing, f) wherein the decorative cover and the at least one air transport portion each have a length, and the length of the air transport portion is at least half of the length of the decorative cover.

10. The filtered cake candle extinguisher kit of claim 9, further comprising a plurality of decorative covers.

11. The filtered cake candle extinguisher kit of claim 10, further comprising a plurality of filters.

* * * * *